US006561758B2

(12) United States Patent
Rinck et al.

(10) Patent No.: US 6,561,758 B2
(45) Date of Patent: May 13, 2003

(54) METHODS AND SYSTEMS FOR COOLING GAS TURBINE ENGINE AIRFOILS

(75) Inventors: Gerard Anthony Rinck, Cincinnati, OH (US); Jonathan Philip Clarke, West Chester, OH (US); Brian Alan Norton, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 78 days.

(21) Appl. No.: 09/844,206

(22) Filed: Apr. 27, 2001

(65) Prior Publication Data

US 2002/0159888 A1 Oct. 31, 2002

(51) Int. Cl.[7] ..... F01D 5/18
(52) U.S. Cl. ..... 415/115; 416/97 R
(58) Field of Search ..... 415/115, 176, 415/178; 416/97 R; 29/889.2, 889.7, 889.721

(56) References Cited

U.S. PATENT DOCUMENTS 5,599,166 A * 2/1997 Deptowicz et al. ..... 416/97 R
5,660,524 A 8/1997 Lee et al.
5,813,118 A 9/1998 Roedl et al.
5,975,851 A * 11/1999 Liang ..... 416/97 R
6,019,579 A * 2/2000 Fukuno et al. ..... 416/97 R
6,036,440 A * 3/2000 Tomita et al. ..... 416/96 R
6,174,135 B1 1/2001 Lee
6,183,811 B1 2/2001 Conner
6,206,638 B1 3/2001 Glynn et al.
6,220,817 B1 4/2001 Durgin et al.
6,234,753 B1 5/2001 Lee

* cited by examiner

*Primary Examiner*—Edward K. Look
*Assistant Examiner*—Ninh Nguyen
(74) *Attorney, Agent, or Firm*—Rodney M. Young; Armstrong Teasdale LLP

(57) ABSTRACT

A gas turbine engine includes rotor blades including airfoils that facilitates reducing manufacturing losses due to airfoil trailing edge scarfing. Each airfoil includes a first and second sidewall connected at a leading edge and a trailing edge. The sidewalls define a cooling cavity that includes at least a leading edge chamber bounded by the sidewalls and the airfoil leading edge, and a trailing edge chamber bounded by sidewalls and the airfoil trailing edge. The cooling cavity trailing edge chamber includes a tip region, a throat, and a passageway region connected in flow communication such that the throat is between the tip region and the passageway region. Furthermore, the tip region is bounded by the airfoil tip and extends divergently from the throat, such that a width of the tip region is greater than a width of the throat.

17 Claims, 3 Drawing Sheets

METHODS AND SYSTEMS FOR COOLING GAS TURBINE ENGINE AIRFOILS

BACKGROUND OF THE INVENTION

This invention relates generally to gas turbine engines, and more specifically to rotor blades used with gas turbine engine combustors.

A gas turbine engine typically includes a core engine having, in serial flow arrangement, a high pressure compressor which compresses airflow entering the engine, a combustor which bums a mixture of fuel and air, and a turbine which includes a plurality of rotor blades that extract rotational energy from airflow exiting the combustor. the burned mixture. Because the turbine is subjected to high temperature airflow exiting the combustor, turbine components are cooled to reduce thermal stresses that may be induced by the high temperature airflow.

The rotating blades include hollow airfoils that are supplied cooling air through cooling circuits. The airfoils include a cooling cavity bounded by sidewalls that define the cooling cavity. To maintain structural integrity of the airfoil, the sidewalls are fabricated to have a thickness of at least 0.168 inches. The cooling cavity is partitioned into cooling chambers that define flow paths for directing the cooling air.

During rotor blade manufacture, a plurality of openings are formed along a trailing edge of the airfoil for discharging cooling air from the airfoil cavity. More specifically, an electro-chemical manufacturing (EDM) process is used to extend the openings from the airfoil trailing edge into the airfoil cavity. As the cooling openings are formed with an EDM electrode, the thickness of the sidewalls may permit the electrode to inadvertently gouge the sidewall causing an undesirable condition known as trailing edge scarfing. Depending on the severity of the scarfing, the structural integrity of the airfoil may be compromised, and the airfoil may need replacing. Furthermore, operation of an airfoil including scarfing, may weaken the airfoil reducing a useful life of the rotor blade.

BRIEF SUMMARY OF THE INVENTION

In an exemplary embodiment, a gas turbine engine includes rotor blades including an airfoil that facilitates reducing manufacturing losses due to airfoil trailing edge scarfing. Each airfoil includes a first and second sidewall connected at a leading edge and a trailing edge. The sidewalls define a cooling cavity that includes at least a leading edge chamber bounded by the sidewalls and the airfoil leading edge, and a trailing edge chamber bounded by sidewalls and the airfoil trailing edge. The cooling cavity trailing edge chamber includes a tip region, a throat, and a passageway region connected in flow communication such that the throat is between the tip region and the passageway region. Furthermore, the tip region is bounded by the airfoil tip and extends divergently from the throat, such that a width of the tip region is greater than a width of the throat.

During an airfoil manufacturing process, an electro-chemical machining (EDM) process is used to form cooling openings that extend between the airfoil trailing edge and the cooling cavity trailing edge chamber. During the EDM process, the reduced thickness of the trailing edge chamber tip region facilitates reducing inadvertent gouging of the airfoil, thus preventing scarfing of the airfoil. As a result, manufacturing losses due to trailing edge scarfing are facilitated to be reduced in a cost-effective and reliable manner.

DETAILED DESCRIPTION OF THE INVENTION

Figure 1:
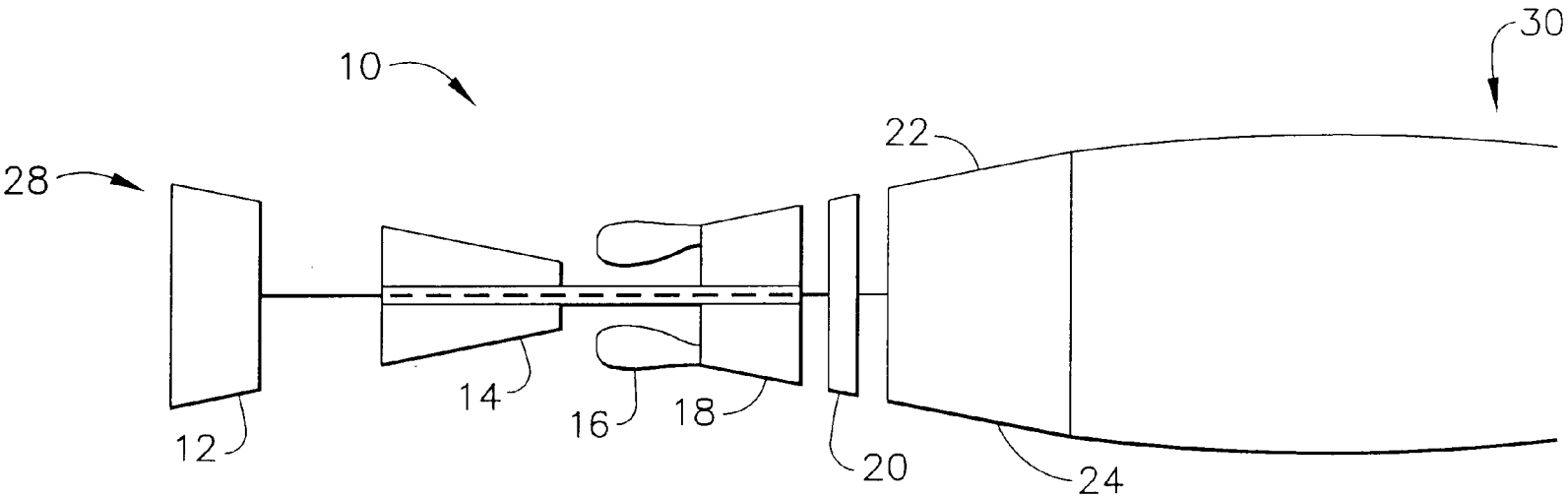
FIG. 1 is schematic illustration of a gas turbine engine.

FIG. 1 is a schematic illustration of a gas turbine engine 10 including a fan assembly 12, a high pressure compressor 14, and a combustor 16. Engine 10 also includes a high pressure turbine 18, a low pressure turbine 20, and a booster 22. Engine 10 has an intake side 28 and an exhaust side 30. In one embodiment, engine 10 is a CF6 engine commercially available from General Electric Company, Cincinnati, Ohio.

In operation, air flows through fan assembly 12 and compressed air is supplied to high pressure compressor 14. The highly compressed air is delivered to combustor 16. Airflow from combustor 16 drives turbines 18 and 20, and turbine 20 drives fan assembly 12.

Figure 2:
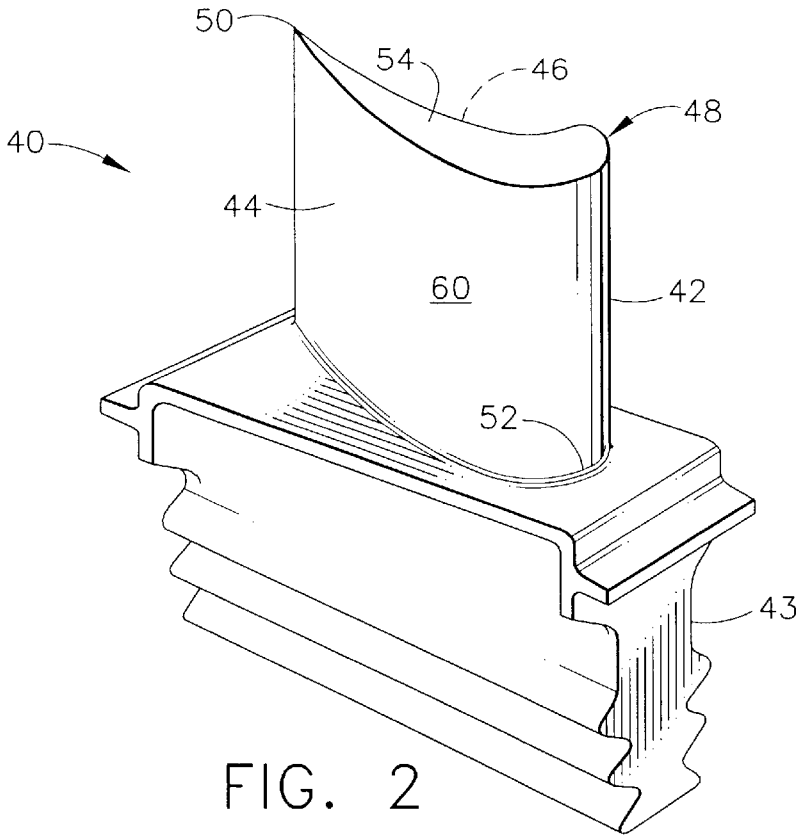
FIG. 2 is a perspective view of an airfoil that may be used with the gas turbine engine shown in FIG. 1.

FIG. 2 is a perspective view of a rotor blade 40 that may be used with a gas turbine engine, such as gas turbine engine 10 (shown in FIG. 1). In one embodiment, a plurality of rotor blades 40 form a high pressure turbine rotor blade stage (not shown) of gas turbine engine 10. Each rotor blade 40 includes a hollow airfoil 42 and an integral dovetail 43 used for mounting airfoil 42 to a rotor disk (not shown) in a known manner. Alternatively, blades 40 may extend radially outwardly from an outer rim (not shown), such that a plurality of blades 40 form a blisk (not shown).

Each airfoil 42 includes a first sidewall 44 and a second sidewall 46. First sidewall 44 is convex and defines a suction side of airfoil 42, and second sidewall 46 is concave and defines a pressure side of airfoil 42. Sidewalls 44 and 46 are joined at a leading edge 48 and at an axially-spaced trailing edge 50 of airfoil 42. Airfoil trailing edge is spaced chordwise and downstream from airfoil leading edge 48.

First and second sidewalls 44 and 46, respectively, extend longitudinally or radially outward in span from a blade root 52 positioned adjacent dovetail 43 to an airfoil tip 54 which defines a radially outer boundary of an internal cooling chamber (not shown in FIG. 2). The cooling chamber is bounded within airfoil 42 between sidewalls 44 and 46. More specifically, airfoil 42 includes an inner surface (not shown in FIG. 2) and an outer surface 60, and the cooling chamber is defined by the airfoil inner surface.

Figure 4:
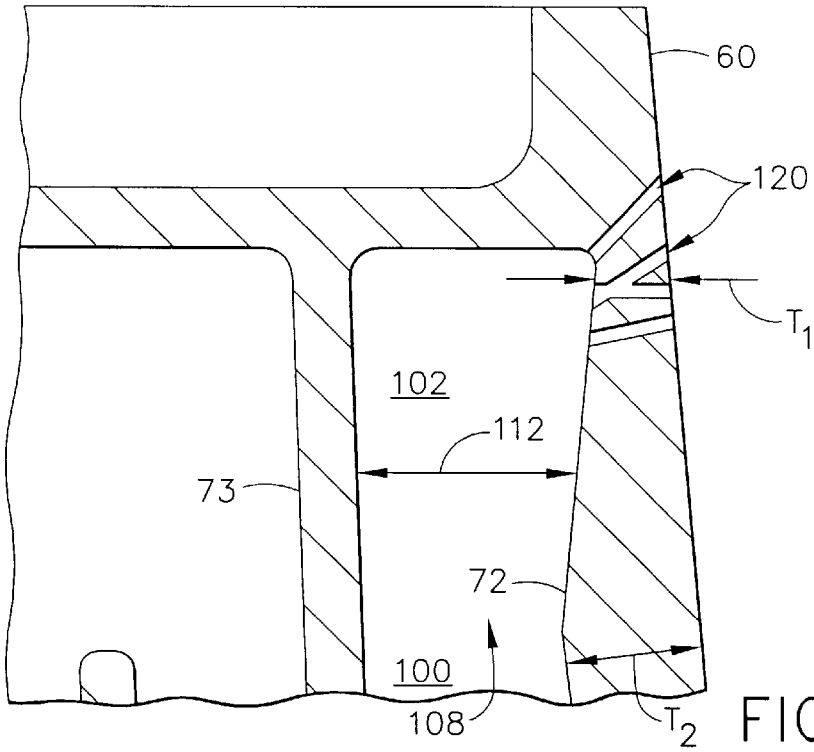
FIG. 4 is an enlarged view of the airfoil shown in FIG. 3 taken along area 4.
Figure 3:
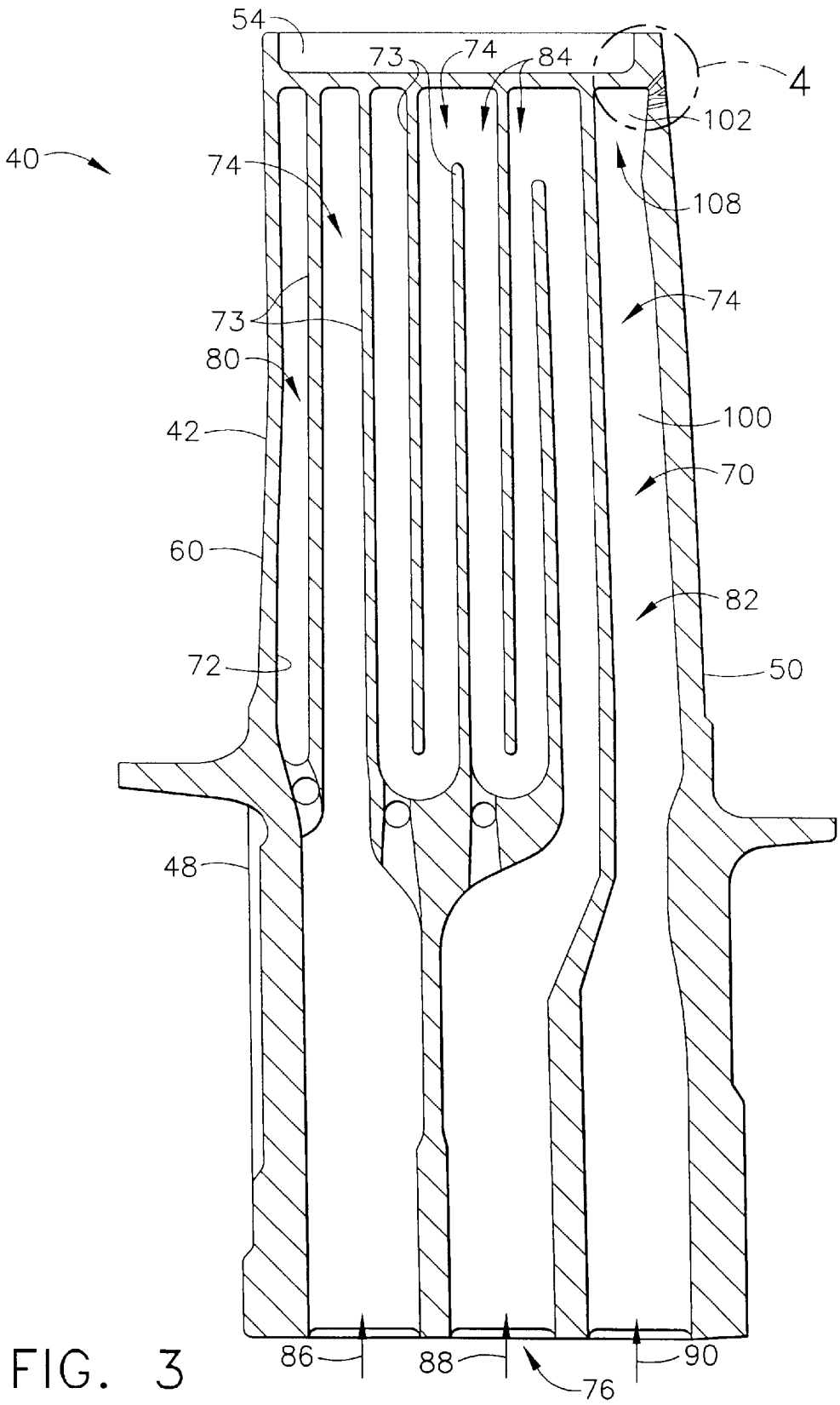
FIG. 3 is a cross sectional view of the airfoil shown in FIG. 2.

FIG. 3 is a cross-sectional view of blade 40 including airfoil 42. FIG. 4 is an enlarged view of airfoil 42 taken along area 4 (shown in FIG. 3). Airfoil 42 includes a cooling cavity 70 defined by an inner surface 72 of airfoil 42. Cooling cavity 70 includes a plurality of inner walls 73 which partition cooling cavity 70 into a plurality of cooling chambers 74. In one embodiment, inner walls 73 are cast integrally with airfoil 42. Cooling chambers 74 are supplied cooling air through a plurality of cooling circuits 76. More specifically, airfoil 42 includes a leading edge cooling chamber 80, a trailing edge cooling chamber 82, and a plurality of intermediate cooling chambers 84. In one embodiment, leading edge cooling chamber 80 is in flow communication with trailing edge and intermediate cooling chambers 82 and 84, respectively.

Leading edge cooling chamber 80 extends longitudinally or radially through airfoil 42 to airfoil tip 54, and is bordered by airfoil first and second sidewalls 44 and 46, respectively (shown in FIG. 2), and by airfoil leading edge 48. Leading edge cooling chamber 80 and an adjacent downstream intermediate cooling chamber 84 are cooled with cooling air supplied by a leading edge cooling circuit 86.

Intermediate cooling chambers 84 are between leading edge cooling chamber 80 and trailing edge cooling chamber 82, and are supplied cooling air by a mid-circuit cooling circuit 88. More specifically, intermediate cooling chambers 84 are in flow communication and form a serpentine cooling passageway. Intermediate cooling chambers 84 are bordered by bordered by airfoil first and second sidewalls 44 and 46, respectively, and by airfoil tip 54.

Trailing edge cooling chamber 82 extends longitudinally or radially through airfoil 42 to airfoil tip 54, and is bordered by airfoil first and second sidewalls 44 and 46, respectively, and by airfoil trailing edge 50. Trailing edge cooling chamber 82 is cooled with cooling air supplied by a trailing edge cooling circuit 90. which defines a radially outer boundary of cooling chamber 82. Additionally, trailing edge cooling chamber 82 includes a passageway region 100 and a tip region 102.

Trailing edge cooling chamber passageway region 100 extends generally convergently from blade root 52 towards airfoil tip 54. More specifically, trailing edge cooling chamber passageway region 100 has an internal width 106 measured between an adjacent inner wall 73 and airfoil inner surface 72. Passageway region width 106 decreases from blade root 52 to a throat 108 located between trailing edge cooling chamber passageway region 100 and tip region 102.

Trailing edge cooling chamber tip region 102 is bordered by airfoil tip 54 and airfoil trailing edge 50, and is in flow communication with passageway region 100. Tip region 102 extends divergently from throat 108 towards airfoil tip 54, such that a width 112 of tip region 102 increases from throat 108 towards airfoil tip 54. Furthermore, within tip region 102, airfoil inner surface 72 extends radially outwardly towards airfoil outer surface 60. As a result, a sidewall thickness $T_1$ within tip region 102 is less than a sidewall thickness $T_2$ within trailing edge cooling chamber passageway region 100. More specifically, tip region sidewall thickness $T_1$ is less than 0.168 inches. In the exemplary embodiment, sidewall thickness $T_1$ is approximately equal 0.108 inches.

A plurality of openings 120 extend between airfoil outer surface 60 and airfoil inner surface 72. More specifically, openings 120 extend from airfoil trailing edge 50 towards airfoil leading edge 48, such that each opening 120 is in flow communication with trailing edge cooling chamber tip region 102. Accordingly, openings 120 are known as trailing edge fan holes. In one embodiment, an electrochemical machining (EDM) process is used to form openings 120.

During manufacture of airfoil 42, because tip region cavity sidewall thickness $T_1$ is approximately equal 0.108 inches, an EDM electrode (not shown) has a reduced travel distance between airfoil trailing edge 50 and trailing edge cooling chamber tip region 102, in comparison to other known airfoils that do not include trailing edge cooling chamber tip region 102. Accordingly, during the EDM process, thickness $T_1$ facilitates reducing inadvertent gouging of airfoil 42 by the EDM electrode in an undesirable process known as scarfing. As a result, manufacturing losses due to trailing edge scarfing are facilitated to be reduced. Furthermore, because a contour of airfoil outer surface 60 is not altered to form sidewall thickness $T_1$, aerodynamic performance of airfoil 42 is not adversely affected.

During engine operation, cooling air is supplied into airfoil 42 through cooling circuits 76. In one embodiment, cooling air is supplied into airfoil 42 from a compressor, such as compressor 14 (shown in FIG. 1). As cooling air enters trailing edge cooling chamber 82 from trailing edge cooling circuit 90, the cooling air flows through airfoil 42 and is discharged through tip region openings 120. Because sidewalls 44 and/or 42 bordering trailing edge cooling chamber tip region 102 have thickness $T_1$, localized operating temperatures within tip region 102 and in the proximity of openings 120 are facilitated to be reduced, thus increasing a resistance to oxidation within tip region 102.

The above-described airfoil is cost-effective and highly reliable. The airfoil includes a trailing edge cooling chamber that includes a tip region that extends divergently from a passageway region. The divergent tip region causes a thickness of bordering sidewalls to be reduced in comparison to a thickness of the sidewalls bordering the remainder of the trailing edge cooling chamber. As a result, the reduced thickness of the trailing edge tip region facilitates reduced manufacturing losses due to scarfing in a cost-effective and reliable manner.

While the invention has been described in terms of various specific embodiments, those skilled in the art will recognize that the invention can be practiced with modification within the spirit and scope of the claims.

What is claimed is:

1. A method for manufacturing an airfoil for a gas turbine engine to facilitate reducing airfoil trailing edge scarfing, said method comprising the steps of:

defining a cavity in the airfoil with a wall including a concave portion and a convex portion connected at a leading edge and at a trailing edge; and dividing the cavity into at least a leading edge chamber and a trailing edge chamber, such that the leading edge chamber is bordered by the airfoil leading edge, and the trailing edge chamber is bordered by the trailing edge and includes a tip region and a passageway region, wherein the trailing edge chamber tip region extends divergently from the passageway region, such that at least a portion of the wall bordering the tip region has a thickness less than 0.168 inches.

2. A method in accordance with claim 1 further comprising the step of forming a plurality of openings extending through the airfoil wall in flow communication with the cavity trailing edge chamber tip region.

3. A method in accordance with claim 1 wherein said step of forming a plurality of openings further comprises the step using an electro-chemical machining (EDM) process to form the openings.

4. A method in accordance with claim 1 wherein said step of dividing the cavity further comprises the step of forming the trailing edge chamber such that the cavity trailing edge chamber tip region extends divergently from the trailing edge chamber passageway, wherein at least a portion of the wall bordering the tip region has a thickness approximately equal 0.108 inches.

5. A method in accordance with claim 1 wherein said step of dividing the cavity further comprises the step of casting the airfoil to include at least the cavity leading edge chamber and the cavity trailing edge cavity.

6. An airfoil for a gas turbine engine, said airfoil comprising:

a leading edge;

a trailing edge;

a first sidewall comprising an inner surface and an outer surface, said sidewall extending in radial span between an airfoil root and an airfoil tip;

a second sidewall connected to said first sidewall at said leading edge and said trailing edge, said second sidewall comprising an inner surface and an outer surface, said second sidewall extending in radial span between the airfoil root and the airfoil tip; and a cooling cavity defined by said first sidewall inner surface and said second sidewall inner surface, said cooling cavity comprising at least a leading edge chamber bounded by said first sidewall, said second sidewall, and said leading edge, and a trailing edge chamber bounded by said first sidewall, said second sidewall, and said trailing edge, said cooling cavity trailing edge chamber comprising a tip region, a throat, and a passageway region, said throat between said tip region and said passageway region, said tip region bounded by the airfoil tip and extending divergently from said throat, such that a width of said tip region is greater than a width of said throat, said airfoil has airfoil has a thickness extending between said sidewall outer and inner surfaces, at least a portion of said airfoil thickness bordering said cooling cavity trailing edge chamber tip region smaller than a thickness of said airfoil bordering said cooling cavity trailing edge chamber throat and said cooling cavity trailing edge passageway region.

7. An airfoil in accordance with claim 6 further comprising a plurality of openings extending into said cooling cavity trailing edge chamber tip region.

8. An airfoil in accordance with claim 6 wherein said airfoil thickness bordering said cooling cavity trailing edge chamber tip region configured to facilitate a reduction in localized metal temperature within said airfoil.

9. An airfoil in accordance with claim 6 wherein said airfoil thickness bordering said cooling cavity trailing edge chamber tip region less than 0.168 inches.

10. An airfoil in accordance with claim 6 wherein said airfoil thickness bordering said cooling cavity trailing edge chamber tip region approximately equal 0.108 inches.

11. An airfoil in accordance with claim 6 wherein said airfoil thickness bordering said cooling cavity trailing edge chamber tip region configured to facilitate reducing airfoil trailing edge scarfing.

12. A gas turbine engine comprising a plurality of airfoils, each said airfoil comprising a leading edge, a trailing edge, a wall, and a cooling cavity defined by said wall, said cooling cavity comprising at least two chambers, a first of said chambers bounded by said leading edge, a second of said chambers bounded by said trailing edge, said second chamber comprising a tip region adjacent said trailing edge, said wall comprising a plurality of openings extending therethrough, such that said openings in flow communication with said cooling chamber second chamber tip region, at least a portion of said wall bordering said tip region having a thickness less than 0.168 inches.

13. A gas turbine engine in accordance with claim 12 wherein each said airfoil cooling cavity second chamber further comprises a passageway region and a throat, said passageway region in flow communication with said tip region, said throat between said passageway region and said tip region.

14. A gas turbine engine in accordance with claim 13 wherein said airfoil cooling cavity second chamber tip region extends divergently from said throat.

15. A gas turbine engine in accordance with claim 13 wherein said airfoil wall bordering said cooling cavity second chamber tip region has a thickness approximately equal 0.108 inches.

16. A gas turbine engine in accordance with claim 13 wherein said airfoil wall bordering said cooling cavity second chamber tip region has a thickness configured to facilitate a reduction in localized metal temperature within said airfoil.

17. A gas turbine engine in accordance with claim 13 wherein said airfoil wall bordering said cooling cavity second chamber tip region has a thickness configured to facilitate reducing airfoil trailing edge scarfing.

* * * * *

UNITED STATES PATENT AND TRADEMARK OFFICE

CERTIFICATE OF CORRECTION

PATENT NO. : 6,561,758 B2
DATED : May 13, 2003
INVENTOR(S) : Rinck et al.

It is certified that error appears in the above-identified patent and that said Letters Patent is hereby corrected as shown below:

Column 4,
Line 59, delete “cavity” and insert therefore -- chamber --.

Column 5,
Line 18, delete “airfoil has”.

Signed and Sealed this

Twenty-third Day of September, 2003

JAMES E. ROGAN
*Director of the United States Patent and Trademark Office*